US009146088B1

(12) United States Patent
Filsinger

(10) Patent No.: US 9,146,088 B1
(45) Date of Patent: Sep. 29, 2015

(54) HIGH SHOCK SURVIVABLE FUZE

(75) Inventor: Fred Gunther Filsinger, Saint Peters, MO (US)

(73) Assignee: The Boeing Company, Chicago, IL (US)

( * ) Notice: Subject to any disclaimer, the term of this patent is extended or adjusted under 35 U.S.C. 154(b) by 463 days.

(21) Appl. No.: 13/444,867

(22) Filed: Apr. 12, 2012

(51) Int. Cl.

| | |
|---|---|
| ***F42B 12/20*** | (2006.01) |
| ***F42C 1/12*** | (2006.01) |
| ***F42C 9/14*** | (2006.01) |
| ***F42C 11/06*** | (2006.01) |
| ***F42C 15/40*** | (2006.01) |
| ***F42C 19/02*** | (2006.01) |
| ***F42C 19/04*** | (2006.01) |
| ***F42C 19/12*** | (2006.01) |

(52) U.S. Cl.
CPC . *F42C 9/14* (2013.01); *F42B 12/20* (2013.01); *F42B 12/204* (2013.01); *F42C 1/12* (2013.01); *F42C 9/147* (2013.01); *F42C 11/06* (2013.01); *F42C 11/065* (2013.01); *F42C 15/40* (2013.01); *F42C 19/02* (2013.01); *F42C 19/04* (2013.01); *F42C 19/12* (2013.01)

(58) Field of Classification Search
CPC ..... F42B 12/02; F42B 12/20; F42B 12/201; F42B 12/204; F42B 12/207; F42C 1/00; F42C 1/10; F42C 1/12; F42C 9/14; F42C 9/147; F42C 11/00; F42C 11/06; F42C 11/065; F42C 15/40; F42C 19/00; F42C 19/02; F42C 19/04; F42C 19/12
USPC ..... 102/202.14, 206, 221, 265, 266, 270, 102/271, 262, 264
See application file for complete search history.

(56) References Cited

U.S. PATENT DOCUMENTS

| | | | | |
|---|---|---|---|---|
| 2,999,461 | A | 9/1961 | Apotheloz et al. | |
| 4,567,830 | A * | 2/1986 | Apotheloz | 102/271 |
| 4,586,436 | A * | 5/1986 | Denney et al. | 102/206 |
| 5,157,221 | A * | 10/1992 | Ronn | 102/216 |
| 5,269,223 | A * | 12/1993 | Mattsson et al. | 102/210 |
| 5,585,592 | A * | 12/1996 | Stearns et al. | 102/233 |
| 6,079,332 | A * | 6/2000 | Marshall et al. | 102/202.5 |
| 6,311,621 | B1 * | 11/2001 | Marshall et al. | 102/202.5 |
| 7,152,532 | B2 * | 12/2006 | Conrad | 102/473 |
| 8,234,979 | B1 * | 8/2012 | Falabella et al. | 102/499 |
| 8,297,189 | B2 * | 10/2012 | Hoffmann et al. | 102/293 |
| 2006/0016360 | A1 * | 1/2006 | Eches et al. | 102/477 |
| 2006/0081149 | A1 * | 4/2006 | Salizzoni et al. | 102/477 |

FOREIGN PATENT DOCUMENTS

| | | | |
|---|---|---|---|
| EP | 0433254 | A1 | 6/1991 |
| GB | 2153052 | A * | 8/1985 |

* cited by examiner

*Primary Examiner* — James S Bergin
(74) *Attorney, Agent, or Firm* — McDonnell Boehnen Hulbert & Berghoff LLP

(57) ABSTRACT

A high shock survivable fuze, system, and method are presented. At least one shock-survivable fuze that survives a high shock environment comprises a timer, a detonator, and a protective housing. The timer sends a fire signal after a programmed delay in response to an arming command. The detonator initiates an explosion in an explosive in response to the fire signal, and the protective housing protects the timer and the detonator from the high shock environment. An arming module communicates with the at least one shock-survivable fuze and sends the arming command.

20 Claims, 3 Drawing Sheets

HIGH SHOCK SURVIVABLE FUZE

FIELD

Embodiments of the present disclosure relate generally to fuzes. More particularly, embodiments of the present disclosure relate to shock survivable fuzes.

BACKGROUND

Deep penetrating warheads may be used to penetrate hardened targets or targets buried deep underground. For example, a massive ordnance penetrator may comprise a penetrating precision-guided 5,000-pound to 30,000-pound explosive. Such explosives are generally fuzed by a single cylinder located at an aft end of an explosive casing. The aft end location can subject the fuze to very high lateral loads referred to as tail slap which can destroy or eject the fuze from the explosive casing during a penetration event and prior to initiation.

SUMMARY

A high shock survivable fuze, system, and method are presented. At least one shock-survivable fuze that survives a high shock environment comprises a timer, a detonator, and a protective housing. The timer sends a fire signal after a programmed delay in response to an arming command. The detonator initiates an explosion in an explosive in response to the fire signal, and the protective housing protects the timer and the detonator from the high shock environment. An arming module communicates with the at least one shock-survivable fuze and sends the arming command.

In this manner, a high shock survivable fuze system separates a survivable section of a fuze and places it in a more benign environment in a center of an explosive casing. The survivable section of the fuze may comprise a timer, a detonator, a keep-alive circuit, and a protective housing. The detonator may comprise a fuze explosive train which may comprise a high voltage firing capacitor, an initiator, a lead charge, and a booster. A non-survivable section of the fuze (for communication and arming) remains in an aft section of the warhead with an interface cable linking the survivable section and the non-survivable section. Once the fuze is armed and senses impact, the aft section and the interface cable is no longer required. A g-sensor can detect an impact and send an arming signal within, for example, milliseconds.

In an embodiment, a high shock survivable fuze system comprises at least one shock-survivable fuze and an arming module. The shock-survivable fuze survives a high shock environment, and comprises a timer, a detonator, and a protective housing. The timer sends a fire signal after a programmed delay in response to an arming command. The detonator initiates an explosion in an explosive in response to the fire signal, and the protective housing protects the timer and the detonator from the high shock environment. The arming module communicates with the at least one shock-survivable fuze and sends the arming command.

In another embodiment, a method for fuzing a high shock survivable penetration warhead sends an arming command from an arming module to at least one shock-survivable fuze comprising a detonator and a timer. The method further protects the timer and the detonator from a high shock environment using a protective housing. The method further sends a fire signal after a programmed delay by action of the timer in response to an arming command, and initiates an explosion in an explosive by action of the detonator in response to the fire signal.

In a further embodiment, a method for providing fuzing for a high shock survivable penetration warhead provides a timer operable to send a fire signal after a programmed delay in response to an arming command. The method further provides a detonator that initiates an explosion in an explosive in response to the fire signal, and provides a protective housing to protect the timer and the detonator from the high shock environment. The method further provides at least one shock-survivable fuze operable to survive a high shock environment, the at least one shock-survivable fuze comprising the timer, the detonator, and the protective housing. The method further provides an arming module operable to communicate with the at least one shock-survivable fuze and send the arming command.

This summary is provided to introduce a selection of concepts in a simplified form that are further described below in the detailed description. This summary is not intended to identify key features or essential features of the claimed subject matter, nor is it intended to be used as an aid in determining the scope of the claimed subject matter.

BRIEF DESCRIPTION OF DRAWINGS

A more complete understanding of embodiments of the present disclosure may be derived by referring to the detailed description and claims when considered in conjunction with the following figures, wherein like reference numbers refer to similar elements throughout the figures. The figures are provided to facilitate understanding of the disclosure without limiting the breadth, scope, scale, or applicability of the disclosure. The drawings are not necessarily made to scale.

DETAILED DESCRIPTION

The following detailed description is exemplary in nature and is not intended to limit the disclosure or the application and uses of the embodiments of the disclosure. Descriptions of specific devices, techniques, and applications are provided only as examples. Modifications to the examples described herein will be readily apparent to those of ordinary skill in the art, and the general principles defined herein may be applied to other examples and applications without departing from the spirit and scope of the disclosure. The present disclosure should be accorded scope consistent with the claims, and not limited to the examples described and shown herein.

Embodiments of the disclosure may be described herein in terms of functional and/or logical block components and various processing steps. It should be appreciated that such block components may be realized by any number of hardware, software, and/or firmware components configured to perform the specified functions. For the sake of brevity, conventional techniques and components related to warheads, explosives, fuzing, and other functional aspects of systems described herein (and the individual operating components of the systems) may not be described in detail herein. In addition, those skilled in the art will appreciate that embodiments of the present disclosure may be practiced in conjunction with a variety of hardware and software, and that the embodiments described herein are merely example embodiments of the disclosure.

Embodiments of the disclosure are described herein in the context of a practical non-limiting application, namely, a high shock survivable penetration warhead. Embodiments of the disclosure, however, are not limited to such high shock survivable penetrator warhead applications, and the techniques described herein may also be utilized in other applications. For example but without limitation, embodiments may be applicable to rugged environment explosives, or other explosive applications.

As would be apparent to one of ordinary skill in the art after reading this description, the following are examples and embodiments of the disclosure and are not limited to operating in accordance with these examples. Other embodiments may be utilized and structural changes may be made without departing from the scope of the exemplary embodiments of the present disclosure.

Figure 1:
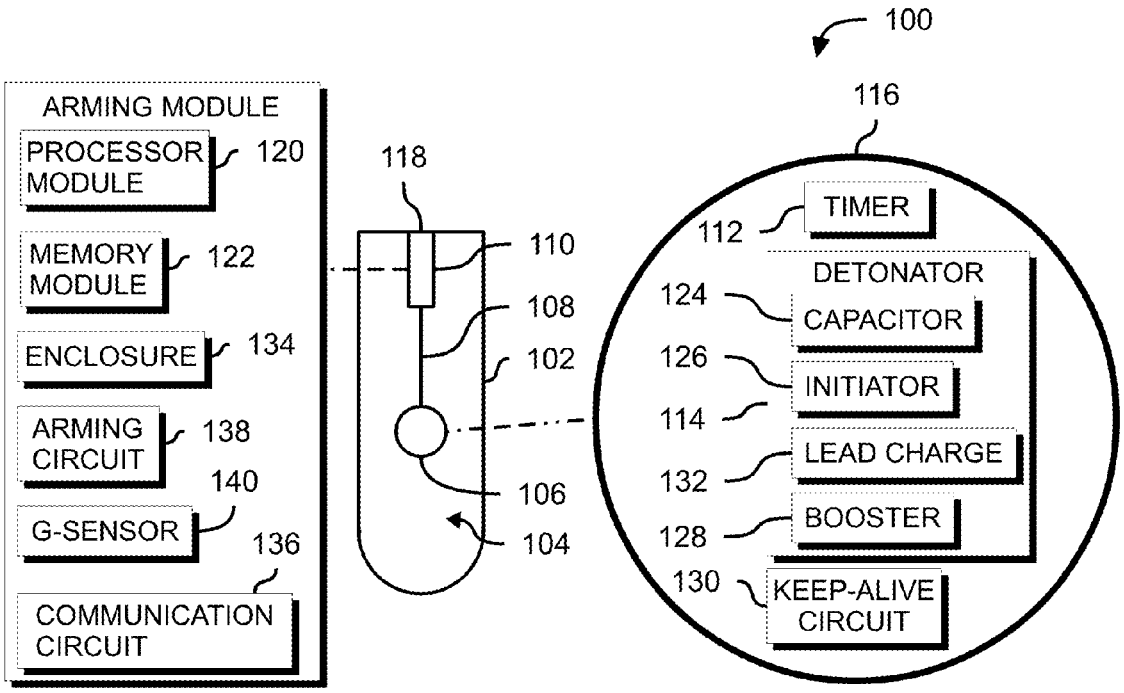
FIG. 1 is an illustration of an exemplary block diagram of a high shock survivable fuze system according to an embodiment of the disclosure.

FIG. 1 is an illustration of an exemplary block diagram of a high shock survivable fuze system 100 (system 100) according to an embodiment of the disclosure. System 100 may comprise a penetrator explosive casing 102, an explosive 104, at least one shock-survivable fuze 106, an interface cable 108, and an arming module 110.

The penetrator explosive casing 102 may comprise, for example but without limitation, a high grade steel, a high density metal, or other casing material. The penetrator explosive casing 102 (explosive casing 102) houses the shock-survivable fuze 106 and the arming module 110.

The explosive 104 may comprise, for example but without limitation, C4, semtex, cyclonite, cyclotrimethylene trinitramine, or other explosive.

The shock-survivable fuze 106 is configured to survive a high shock environment. The shock-survivable fuze 106 may comprise a timer 112, a detonator 114, a keep-alive circuit 130, and a protective housing 116. The shock-survivable fuze 106 may comprise a plurality of the shock-survivable fuzes 106 distributed in the explosive casing 102. The high shock environment may comprise, for example but without limitation, a sudden acceleration, a sudden deceleration, a pressure increase, a high g penetration event, or other transient physical excitation. For example but without limitation, the high shock environment may comprise 15,000 pounds per square inch (psi) of external over pressure.

The timer 112 is configured to send a fire signal after a programmed delay in response to an arming command.

The detonator 114 is configured to initiate an explosion in the explosive 104 in response to the fire signal. The detonator 114 may comprise, for example but without limitation, a fuze explosive train comprising a firing capacitor 124 (electric storage device), an initiator 126, a lead charge 132, and a booster 128. For example, in operation, the firing capacitor 124 can store a high voltage firing energy for the initiator 126 which fires a lead charge 132. The lead charge 132 increases a pressure wave which initiates the booster 128 charge. The booster 128 charge further increases the pressure wave to initiate the explosive 104.

The firing capacitor 124 can store a high voltage firing energy for the initiator 126. While the firing capacitor 124 is an embodiment of an electrical storage device, other embodiments may comprise, for example but without limitation, a high energy battery, a hybrid capacitor/battery, or other electrical storage device.

The initiator 126 is operable to provide an initial explosion in response to the fire signal. The initiator 126 may comprise, for example but without limitation, a low energy electronic foil initiator (LEEFI), or other initiator.

The lead charge 132 may be coupled between the initiator 126 and the booster 128 to increase a pressure wave from the initiator 126 which initiates the booster 128.

The booster 128 is operable to enhance the initial explosion from the initiator 126 and/or the lead charge 132 to further increase the pressure wave from the initiator 126 and/or the lead charge 132 to initiate an explosion in the explosive 104.

The keep-alive circuit 130 is operable to provide power to electronic components of the shock-survivable fuze 106 such as, for example, the timer 112 and the detonator 114. The keep-alive circuit 130 may comprise, for example but without limitation, a power supply, a capacitor power supply, a battery power supply, a hybrid capacitor/battery power supply, or other power supply circuit. The keep-alive circuit 130 may be combined with other components of the shock-survivable fuze 106 such as, for example, the timer 112.

The protective housing 116 protects all components comprised therein from both high shock and high pressure environments. The protective housing 116 is configured to protect the timer 112, the detonator 114, and the keep-alive circuit 130 from the high shock environment and high pressure environment. The protective housing 116 may comprise, for example but without limitation, a sealed spherical shape, or other shape. The sealed spherical shape protects the shock-survivable fuze 106. The shock-survivable fuze 106 matches a density of the explosive 104 so that relative motion between the shock-survivable fuze 106 and the explosive is minimized to limit friction/auto detonation.

The interface cable 108 is coupled to the arming module 110 and the shock-survivable fuze 106 and is configured to communicate the arming command and/or a high voltage arming power from the arming module 110 to the shock-survivable fuze 106. The interface cable 108 may comprise, for example but without limitation, a shielded cable, communication wires, arming wires, a connector, a break link, or other component. The shielded cable may comprise, for example but without limitation, an electro-magnetic interference protection, or other cable shield. The communication wires may provide signal communication between the arming module 110 and the shock-survivable fuze 106, and may comprise, for example but without limitation, an optical fiber, a coaxial cable, a twisted pair cable, or other communication cable.

The arming wires may send a high voltage power from the arming module 110 to the shock-survivable fuze 106, and may comprise, for example but without limitation, a twisted pair cable, or other cable. The connector may comprise, for example but without limitation, a connector which only attaches to the the arming module 110 and the shock-survivable fuze 106 and potted to eliminate shape edges, or other connector. The break link may comprise, for example but without limitation, a link to assure that heaving of the explosive 104 does not rip the interface cable 108 prematurely, or other link.

The arming module 110 is configured to communicate with the shock-survivable fuze 106 and send an arming command and/or a high voltage arming power to the shock-survivable fuze 106. The arming module 110 may be located at an aft end 118 of the penetrator explosive casing 102. Components of the arming module 110 may not necessarily survive a deep penetration impact of the system 100, when the system 100 comprises a deep penetration warhead.

The arming module 110 may comprise, for example but without limitation, a processor module 120, a memory module 122, an enclosure 134, a communication circuit 136, an arming circuit 138, a g-sensor 140, or other module. The enclosure 134 may comprise, for example but without limitation, a cylinder fuze case, or other enclosure. The communication circuit 136 may be operable to acknowledge arming signals, communicate programming to the shock-survivable fuze 106, set ready to arm circuit, set timer delays and sends an impact signal to the shock-survivable fuze 106. The arming circuit 138 may be operable to send a high voltage power to charge the firing capacitor 124. The g-sensor 140 may be operable to sense an impact, and may comprise, for example but without limitation, a g-switch, an accelerometer, or other sensor.

The processor module 120 comprises processing logic that is configured to carry out the functions, techniques, and processing tasks associated with the operation of the system 100/200. In particular, the processing logic is configured to support the system 100/200 described herein. For example, the processor module 120 may direct the timing circuit to send the fire signal after the programmed delay in response to the arming command.

The processor module 120 may be implemented, or realized, with a general purpose processor, a content addressable memory, a digital signal processor, an application specific integrated circuit, a field programmable gate array, any suitable programmable logic device, discrete gate or transistor logic, discrete hardware components, or any combination thereof, designed to perform the functions described herein. In this manner, a processor may be realized as a microprocessor, a controller, a microcontroller, a state machine, or the like. A processor may also be implemented as a combination of computing devices, e.g., a combination of a digital signal processor and a microprocessor, a plurality of microprocessors, one or more microprocessors in conjunction with a digital signal processor core, or any other such configuration.

The memory module 122 may comprise a data storage area with memory formatted to support the operation of the system 100/200. The memory module 122 is configured to store, maintain, and provide data as needed to support the functionality of the system 100/200. For example but without limitation, the memory module 122 may store the programmed delay, the arming command, or other data.

In practical embodiments, the memory module 122 may comprise, for example but without limitation, a non-volatile storage device (non-volatile semiconductor memory, hard disk device, optical disk device, and the like), a random access storage device (for example, SRAM, DRAM), or any other form of storage medium known in the art.

The memory module 122 may be coupled to the processor module 120 and configured to store, for example but without limitation, a database, a computer program that is executed by the processor module 120, an operating system, an application program, tentative data used in executing a program, or other application. Additionally, the memory module 122 may represent a dynamically updating database containing a table for updating the database, and the like.

The memory module 122 may be coupled to the processor module 120 such that the processor module 120 can read information from and write information to the memory module 122. For example, the processor module 120 may access the memory module 122 to access the programmed delay, or other data.

As an example, the processor module 120 and memory module 122 may reside in respective application specific integrated circuits (ASICs) or other programmable devices. The memory module 122 may also be integrated into the processor module 120. In an embodiment, the memory module 122 may comprise a cache memory for storing temporary variables or other intermediate information during execution of instructions to be executed by the processor module 120.

Figure 2:
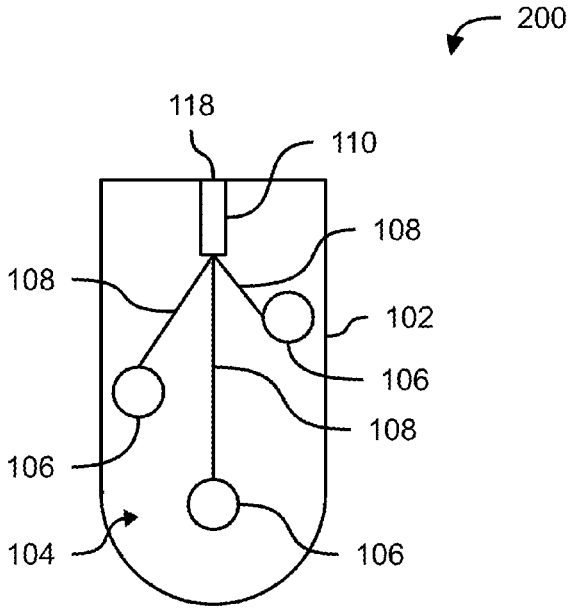
FIG. 2 is an illustration of an exemplary block diagram of a high shock survivable fuze system comprising multiple survivable fuzes according to an embodiment of the disclosure.

FIG. 2 is an illustration of an exemplary block diagram of a high shock survivable fuze system 200 comprising multiple survivable fuzes 106 according to an embodiment of the disclosure. The system 200 may have functions, material, and structures that are similar to the system 100. Therefore common features, functions, and elements may not be redundantly described here.

Figure 3:
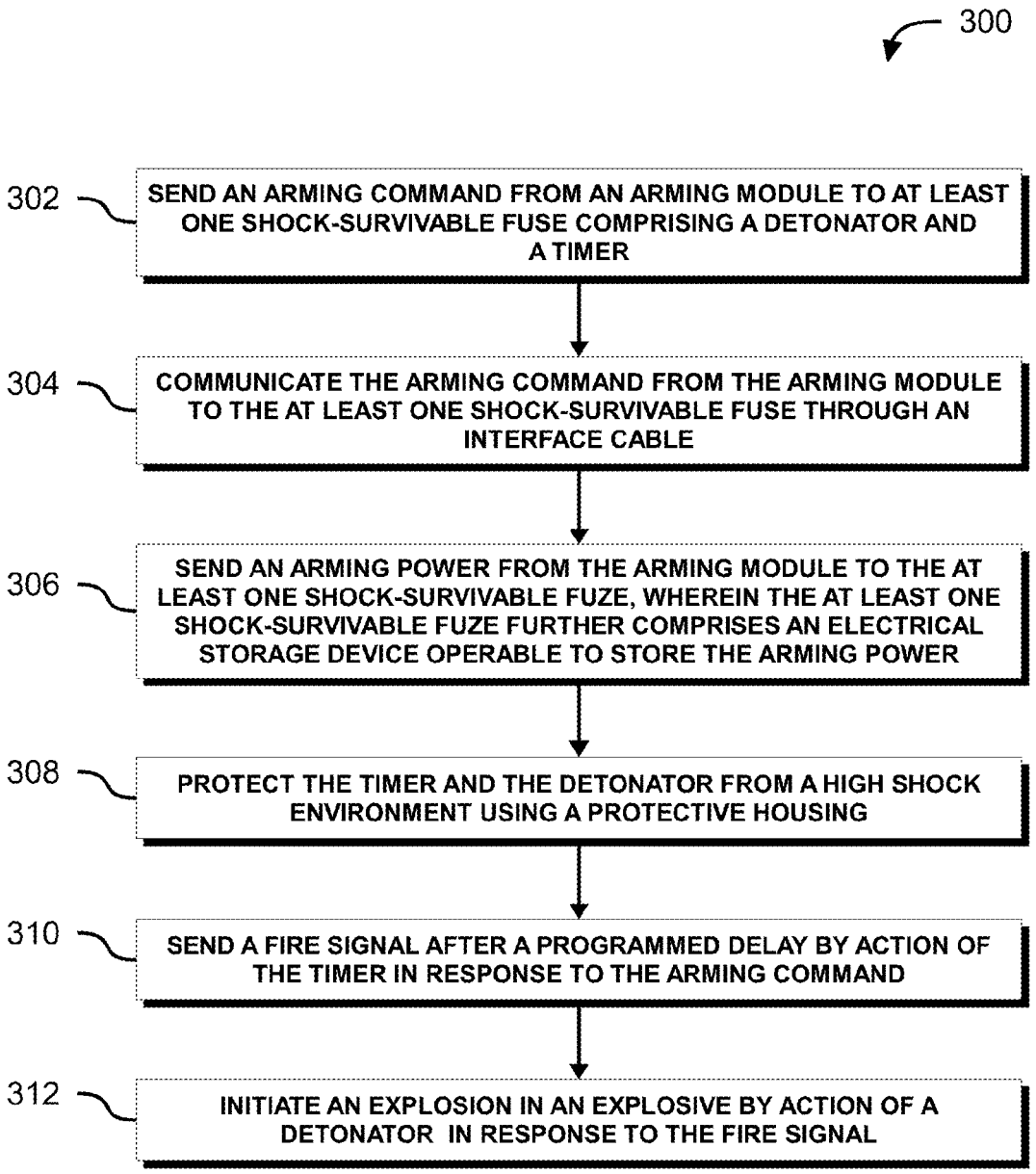
FIG. 3 is an illustration of an exemplary flowchart showing a process for fuzing a high shock survivable penetration warhead according to an embodiment of the disclosure.

FIG. 3 is an illustration of an exemplary flowchart showing a process 300 for fuzing a high shock survivable penetration warhead according to an embodiment of the disclosure. The various tasks performed in connection with process 300 may be performed mechanically, by software, hardware, firmware, computer-readable software, computer readable storage medium, or any combination thereof. It should be appreciated that process 300 may include any number of additional or alternative tasks, the tasks shown in FIG. 3 need not be performed in the illustrated order, and the process 300 may be incorporated into a more comprehensive procedure or process having additional functionality not described in detail herein.

For illustrative purposes, the following description of process 300 may refer to elements mentioned above in connection with FIGS. 1-2. In some embodiments, portions of the process 300 may be performed by different elements of the system 100 and 200 such as: the penetrator explosive casing 102, the explosive 104, the shock-survivable fuze 106, the interface cable 108, the arming module 110, etc. It should be appreciated that process 300 may include any number of additional or alternative tasks, the tasks shown in FIG. 3 need not be performed in the illustrated order, and the process 300 may be incorporated into a more comprehensive procedure or process having additional functionality not described in detail herein. The process 300 may have functions, material, and structures that are similar to the systems 100-200. Therefore common features, functions, and elements may not be redundantly described here.

Process 300 may begin by sending an arming command from an arming module such as the arming module 110 to at least one shock-survivable fuze such as the shock-survivable fuze 106 comprising a detonator such as the detonator 114, and a timer such as the timer 112 (task 302).

Process 300 may continue by communicating the arming command from the arming module 110 to the at least one shock-survivable fuze 106 through an interface cable such as the interface cable 108 (task 304).

Process 300 may continue by sending an arming power from the arming module 110 to the at least one shock-survivable fuze 106, wherein the at least one shock-survivable fuze 106 further comprises an electrical storage device such as the firing capacitor 124 operable to store the arming power (task 306).

Process 300 may continue by protecting the timer 112 and the detonator 114 from a high shock environment using a protective housing such as the protective housing 116 (task 308). As discussed above, the high shock environment may comprise, for example but without limitation, a sudden acceleration, a sudden deceleration, a pressure increase, a high g penetration event, or other transient physical excitation.

Process 300 may continue by sending a fire signal after a programmed delay by action of the timer 112 in response to the arming command (task 310).

Process 300 may continue by initiating an explosion in an explosive such as the explosive 104 by action of the detonator 114 in response to the fire signal (task 312).

Figure 4:
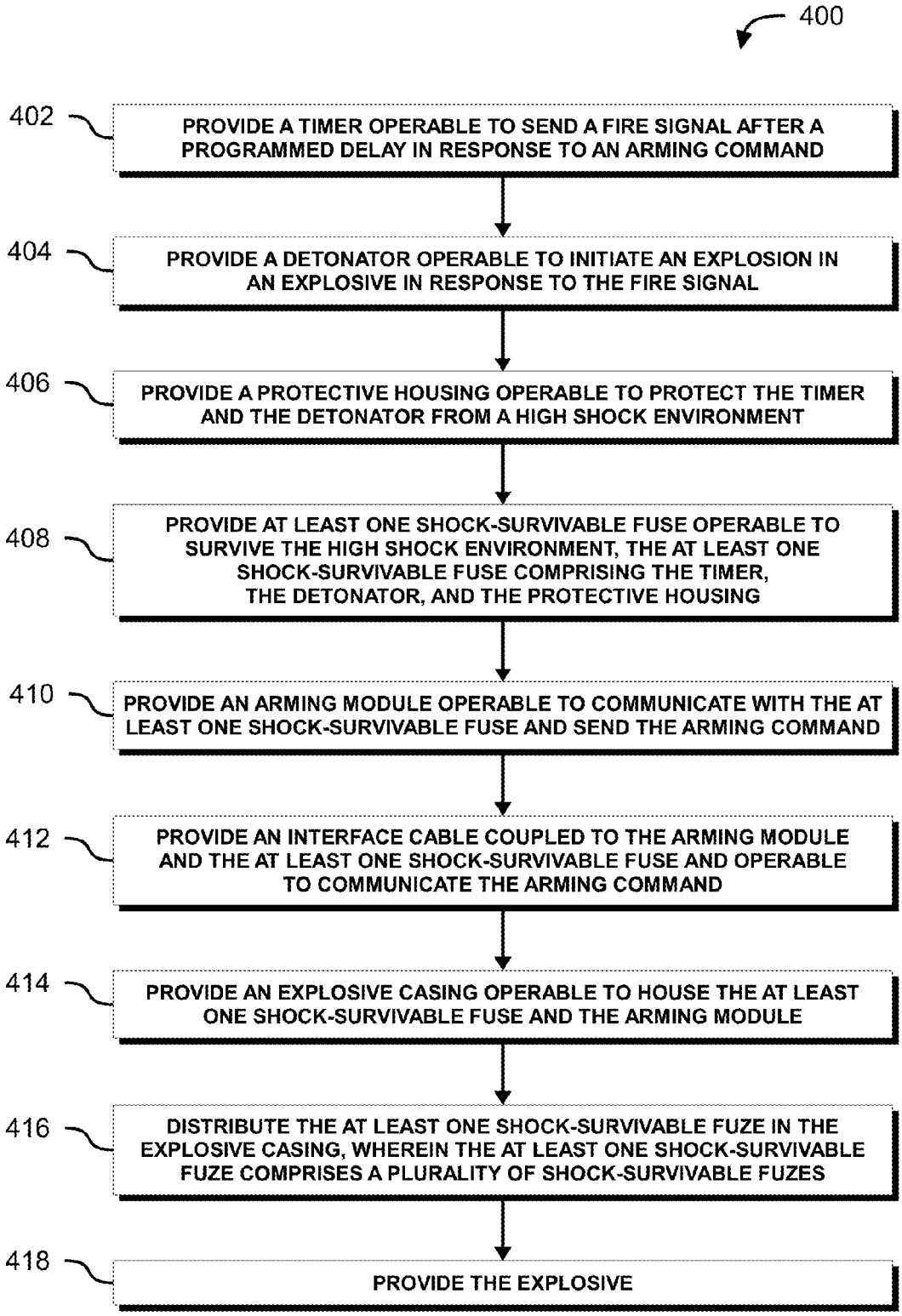
FIG. 4 is an illustration of an exemplary flowchart showing a process for providing a high shock survivable penetration warhead according to an embodiment of the disclosure.

FIG. 4 is an illustration of an exemplary flowchart showing a process 400 for providing a high shock survivable penetration warhead according to an embodiment of the disclosure. The various tasks performed in connection with process 400 may be performed mechanically, by software, hardware, firmware, computer-readable software, computer readable storage medium, or any combination thereof. It should be appreciated that process 400 may include any number of additional or alternative tasks, the tasks shown in FIG. 4 need not be performed in the illustrated order, and the process 400 may be incorporated into a more comprehensive procedure or process having additional functionality not described in detail herein.

For illustrative purposes, the following description of process 400 may refer to elements mentioned above in connection with FIGS. 1-2. In some embodiments, portions of the process 400 may be performed by different elements of the system 100/200 such as: the penetrator explosive casing 102, the explosive 104, the shock-survivable fuze 106, the interface cable 108, the arming module 110, etc. It should be appreciated that process 400 may include any number of additional or alternative tasks, the tasks shown in FIG. 4 need not be performed in the illustrated order, and the process 400 may be incorporated into a more comprehensive procedure or process having additional functionality not described in detail herein. The process 400 may have functions, material, and structures that are similar to the systems 100-200. Therefore common features, functions, and elements may not be redundantly described here.

Process 400 may begin by providing a timer such as the timer 112 operable to send a fire signal after a programmed delay in response to an arming command (task 402).

Process 400 may continue by providing a detonator such as the detonator 114 operable to initiate an explosion in an explosive such as the explosive 104 in response to the fire signal (task 404).

Process 400 may continue by providing a protective housing such as the protective housing 116 operable to protect the timer 112 and the detonator 114 from a high shock environment (task 406). As discussed above, the high shock environment may comprise, for example but without limitation, a sudden acceleration, a sudden deceleration, a pressure increase, a high g penetration event, or other transient physical excitation.

Process 400 may continue by providing at least one shock-survivable fuze such as the at least one shock-survivable fuze 106 operable to survive the high shock environment, the at least one shock-survivable fuze 106 comprising the timer 112, the detonator 114, and the protective housing 116 (task 408).

Process 400 may continue by providing an arming module such as the arming module 110 operable to communicate with the at least one shock-survivable fuze 106 and send the arming command (task 410).

Process 400 may continue by providing an interface cable such as the interface cable 108 coupled to the arming module 110 and the at least one shock-survivable fuze 106 and operable to communicate the arming command (task 412).

Process 400 may continue by providing an explosive casing such as the explosive casing 102 operable to house the at least one shock-survivable fuze 106 and the arming module 110 (task 414).

Process 400 may continue by distributing the at least one shock-survivable fuze 106 in the explosive casing 102, wherein the at least one shock-survivable fuze 106 comprises a plurality of shock-survivable fuzes 106 (task 416).

Process 400 may continue by providing the explosive 104 (task 418).

In this manner, a high shock survivable fuze system separates a survivable section of a fuze and places it in a more benign environment in a center of an explosive casing. The survivable section of the fuze may comprise a timer, a detonator, a keep-alive circuit, and a protective housing. The detonator may comprise a fuze explosive train which may comprise a high voltage firing capacitor, an initiator, a lead charge, and a booster. A non-survivable section of the fuze (for communication and arming) remains in an aft section of the warhead with an interface cable linking the survivable section and the non-survivable section. Once the fuze is armed and senses impact, the aft section and the interface cable is no longer required. A g-sensor can detect an impact and send an arming signal within, for example, milliseconds.

Terms and phrases used in this document, and variations thereof, unless otherwise expressly stated, should be construed as open ended as opposed to limiting. As examples of the foregoing: the term "including" should be read as meaning "including, without limitation" or the like; the term "example" is used to provide exemplary instances of the item in discussion, not an exhaustive or limiting list thereof; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future.

Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although items, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

The above description refers to elements or nodes or features being "connected" or "coupled" together. As used herein, unless expressly stated otherwise, "connected" means that one element/node/feature is directly joined to (or directly communicates with) another element/node/feature, and not necessarily mechanically. Likewise, unless expressly stated otherwise, "coupled" means that one element/node/feature is directly or indirectly joined to (or directly or indirectly communicates with) another element/node/feature, and not necessarily mechanically. Thus, although FIG. 1 depicts example arrangements of elements, additional intervening elements, devices, features, or components may be present in an embodiment of the disclosure.

In this document, the terms "computer program product", "computer-readable medium", "computer readable storage medium", and the like may be used generally to refer to media such as, for example, memory, storage devices, or storage unit. These and other forms of computer-readable media may be involved in storing one or more instructions for use by the processor module 120 to cause the processor module 120 to perform specified operations. Such instructions, generally referred to as "computer program code" or "program code" (which may be grouped in the form of computer programs or other groupings), when executed, enable the systems 100 and 200.

As used herein, unless expressly stated otherwise, "operable" means able to be used, fit or ready for use or service, usable for a specific purpose, and capable of performing a recited or desired function described herein. In relation to systems and devices, the term "operable" means the system and/or the device is fully functional and calibrated, comprises elements for, and meets applicable operability requirements to perform a recited function when activated. In relation to systems and circuits, the term "operable" means the system and/or the circuit is fully functional and calibrated, comprises logic for, and meets applicable operability requirements to perform a recited function when activated.

The invention claimed is:

1. A high shock survivable fuze system comprising:

at least one fuze operable to survive a shock environment, the at least one fuze comprising:

a timer operable to send a fire signal after a programmed delay in response to an arming command;

a detonator operable to initiate an explosion in an explosive in response to the fire signal; and a protective housing operable to enclose and protect the timer and the detonator from the shock environment;

an arming module operable to communicate with the at least one fuze and send the arming command, the arming module located separately from the at least one fuze and outside the protective housing; and a penetrator casing configured to house the at least one fuze enclosed in the protective housing and the arming module, and configured to operate in the shock environment.

2. The high shock survivable fuze system of claim 1, wherein the detonator comprises:

an initiator operable to provide an initial explosion in response to the fire signal; and a booster operable to enhance the initial explosion to initiate the explosion in the explosive.

3. The high shock survivable fuze system of claim 1, wherein the arming module is further operable to send a high voltage arming power to the at least one fuze.

4. The high fuze system of claim 1, wherein the at least one fuze comprises a plurality of fuzes distributed in the penetrator casing.

5. The high fuze system of claim 1, further comprising an interface cable coupled to the arming module and the at least one fuze and operable to communicate the arming command.

6. The high shock survivable fuze system of claim 1, wherein the protective housing of the at least one fuze comprises a sealed spherical shape.

7. The high shock survivable fuze system of claim 1, wherein the at least one fuze matches a density of the explosive so that a relative motion between the at least one fuze and the explosive is minimized to limit friction and auto detonation.

8. A method for fuzing a high shock survivable penetration warhead, the method comprising:

sending an arming command from an arming module to at least one fuze comprising a detonator and a timer enclosed in a protective housing and housed in a penetrator casing comprising the at least one fuze located in an explosive, the arming module located separately from the at least one fuze and outside the protective housing;

protecting the timer and the detonator from a shock environment using the protective housing;

sending a fire signal after a programmed delay by action of the timer in response to the arming command; and initiating an explosion in the explosive by action of the detonator in response to the fire signal.

9. The method of claim 8, further comprising protecting the at least one fuze via a distribution of a plurality of fuzes in the penetrator casing, wherein the at least one fuze comprises the plurality of fuzes distributed in the penetrator casing.

10. The method of claim 8, further comprising communicating the arming command from the arming module to the at least one fuze through an interface cable.

11. The method of claim 8, further comprising sending an arming power from the arming module to the at least one fuze, wherein the at least one fuze further comprises an electrical storage device operable to store the arming power.

12. The method of claim 8, further comprising matching the at least one fuze to a density of the explosive so that a relative motion between the at least one fuze and the explosive is minimized to limit friction and auto detonation.

13. A method for providing fuzing for a high shock survivable penetration warhead, the method comprising:

configuring a timer to send a fire signal after a programmed delay in response to an arming command;

configuring a detonator to initiate an explosion in an explosive in response to the fire signal;

configuring a protective housing to enclose and protect the timer and the detonator from a shock environment;

configuring at least one fuze to operate in a shock environment, the at least one fuze comprising the timer, and the detonator;

configuring the at least one fuze enclosed in the protective housing in a penetrator casing; and housing in the penetrator casing an arming module operable to communicate with the at least one fuze and send the arming command, the arming module located separately from the at least one fuze and outside the protective housing.

14. The method of claim 13, further comprising configuring the detonator to comprise:

an initiator operable to provide an initial explosion in response to the fire signal; and a booster operable to enhance the initial explosion to initiate the explosion in the explosive.

15. The method of claim 13, further comprising configuring an interface cable coupled to the arming module and the at least one fuze to communicate the arming command.

16. The method of claim 13, further comprising distributing the at least one fuze in the penetrator casing, wherein the at least one fuze comprises a plurality of fuzes.

17. The method of claim 16, further comprising coupling a plurality of interface cables from the arming module to each of the fuzes respectively, the interface cables configured to communicate the arming command.

18. The method of claim 13, further comprising configuring the protective housing of the at least one fuze as a sealed spherical shape.

19. The method of claim 13, further comprising configuring the at least one fuze to match a density of the explosive so that a relative motion between the at least one fuze and the explosive is minimized to limit friction and auto detonation.

20. The method of claim 13, further comprising configuring the at least one fuze to operate in the shock environment comprising 1034 bar (15,000 psi) external over pressure.

* * * * *